US010955768B2

(12) United States Patent
Ariizumi

(10) Patent No.: US 10,955,768 B2
(45) Date of Patent: Mar. 23, 2021

(54) DEVELOPING APPARATUS AND CONVEYANCE SCREW

(71) Applicant: CANON KABUSHIKI KAISHA, Tokyo (JP)

(72) Inventor: Osamu Ariizumi, Matsudo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/889,851

(22) Filed: Jun. 2, 2020

(65) Prior Publication Data

US 2020/0387086 A1 Dec. 10, 2020

(30) Foreign Application Priority Data

Jun. 6, 2019 (JP) ..... JP2019-105871

(51) Int. Cl.
*G03G 15/08* (2006.01)

(52) U.S. Cl.
CPC ..... *G03G 15/0891* (2013.01); *G03G 15/0812* (2013.01); *G03G 2215/0827* (2013.01); *G03G 2215/0888* (2013.01)

(58) Field of Classification Search
CPC ..... G03G 15/0891; G03G 15/0812; G03G 2215/0827; G03G 2215/0888; G03G 15/0853; G03G 15/0849
See application file for complete search history.

(56) References Cited

U.S. PATENT DOCUMENTS 6,834,175 B2 12/2004 Murayama et al.
7,953,331 B2 5/2011 Oshige et al.
10,642,192 B2 5/2020 Ariizumi et al.
2002/0159781 A1* 10/2002 Hatori ..... G03G 15/0853 399/30
2007/0223944 A1* 9/2007 Mizuta ..... G03G 15/0849 399/27
2016/0139542 A1* 5/2016 Furukawa ..... G03G 15/0891 399/256
2017/0269505 A1 9/2017 Ariizumi et al.
2018/0335725 A1 11/2018 Ariizumi et al.
2019/0391511 A1 12/2019 Ariizumi et al.

FOREIGN PATENT DOCUMENTS

JP 2003-270947 A 9/2003
JP 2009-047714 A 3/2009
JP 2011-107643 A 6/2011
JP 2012-145777 A 8/2012

* cited by examiner

*Primary Examiner* — Sandra Brase
(74) *Attorney, Agent, or Firm* — Venable LLP

(57) ABSTRACT

According to a first aspect of the present invention, a developing apparatus includes a developer container, a conveyance screw, and an inductance sensor. The conveyance screw further comprises a rib, protruding in a radial direction from the shaft portion, provided at a position opposed to the inductance sensor, and a second blade portion provided continuously to an upstream end portion of the rib with respect to the conveyance direction and configured to convey the developer to the conveyance direction by rotation. The second blade portion is formed to extend not more than one-third of a turn from the upstream end portion of the rib downstream in a direction of rotation of the conveyance screw when viewed in an axial direction of the conveyance screw.

20 Claims, 15 Drawing Sheets

DEVELOPING APPARATUS AND CONVEYANCE SCREW

BACKGROUND OF THE INVENTION

Field of the Invention

The present invention relates to a developing apparatus and a conveyance screw applied to an image forming apparatus adopting an electrophotographic system or an electrostatic recording system.

Description of the Related Art

Hitherto, image forming apparatuses adopting an electrophotographic system or an electrostatic recording system are widely applied as copying machines, printers, facsimiles and multifunction devices having a plurality of such functions. In general, developing apparatuses provided in the image forming apparatuses adopting the electrophotographic system or the electrostatic recording system use either a one-component developer containing magnetic toner as a main component or a two-component developer containing non-magnetic toner and magnetic carrier as main components. Especially in image forming apparatuses that form full-color or multi-color images using electrophotographic systems, two-component developer is used in most developing apparatuses from the viewpoint of image tone and the like.

An agitating member for sufficiently agitating replenished toner and carrier has been developed for such developing apparatus using two-component developer. For example, a configuration for improving agitating efficiency is known, which provides an agitation rib serving as an agitating member arranged in a conveyance direction along a conveyance screw configured to convey developer inside a developer container of the developing apparatus (refer to Japanese Patent Application Laid-Open No. 2003-270947).

However, according to the developing apparatus disclosed in Japanese Patent Application Laid-Open No. 2003-270947, if bulk density of developer is not stabilized due to the difference in rotational speed of the conveyance screw or the amount of developer being conveyed by the conveyance screw, there is a risk that measurement accuracy of toner density measured by an inductance sensor may be deteriorated. Thus, there is a demand for a new configuration that enables to stabilize the bulk density of developer conveyed by the conveyance screw regardless of the difference in rotational speed of conveyance screw or the amount of developer conveyed by the conveyance screw.

The present disclosure provides a developing apparatus and a conveyance screw that stabilizes the bulk density of developer conveyed by the conveyance screw and improves the measurement accuracy of toner density measured by an inductance sensor.

SUMMARY OF THE INVENTION

According to a first aspect of the present invention, a developing apparatus includes a developer container configured to accommodate developer comprising toner and carrier, a conveyance screw comprising a shaft portion provided rotatably on the developer container, and a first blade portion comprising a helical shape, the first blade portion being configured to rotate integrally with the shaft portion and convey the developer accommodated in the developer container in a conveyance direction by rotation, and an inductance sensor arranged to oppose a portion, in a circumferential direction, of the conveyance screw and configured to detect toner density of the developer accommodated in the developer container. The conveyance screw further comprises a rib, protruding in a radial direction from the shaft portion, provided at a position opposed to the inductance sensor, and a second blade portion provided continuously to an upstream end portion of the rib with respect to the conveyance direction and configured to convey the developer to the conveyance direction by rotation. The second blade portion is formed to extend not more than one-third of a turn from the upstream end portion of the rib downstream in a direction of rotation of the conveyance screw when viewed in an axial direction of the conveyance screw.

According to a second aspect of the present invention, a developing apparatus includes a shaft portion provided rotatably on a developer container configured to accommodate developer comprising toner and carrier, a first blade portion comprising a helical shape and configured to rotate integrally with the shaft portion and convey developer accommodated in the developer container in a conveyance direction by rotation, a rib, protruding in a radial direction from the shaft portion, provided at a position opposed to an inductance sensor arranged to oppose a portion, in a circumferential direction, of the conveyance screw and configured to detect toner density of the developer accommodated in the developer container, and a second blade portion provided continuously to an upstream end portion of the rib with respect to the conveyance direction and configured to convey the developer to the conveyance direction by rotation. The second blade portion is formed to extend not more than one-third of a turn from the upstream end portion of the rib downstream in a direction of rotation of the conveyance screw when viewed in an axial direction of the conveyance screw.

Further features of the present invention will become apparent from the following description of exemplary embodiments with reference to the attached drawings.

DESCRIPTION OF THE EMBODIMENTS

First Embodiment

Now, a first embodiment of the present invention will be described in detail with reference to FIGS. 1 to 13. At first, a general configuration of an image forming apparatus according to the present embodiment will be described with reference to FIG. 1.

Image Forming Apparatus

Figure 1:
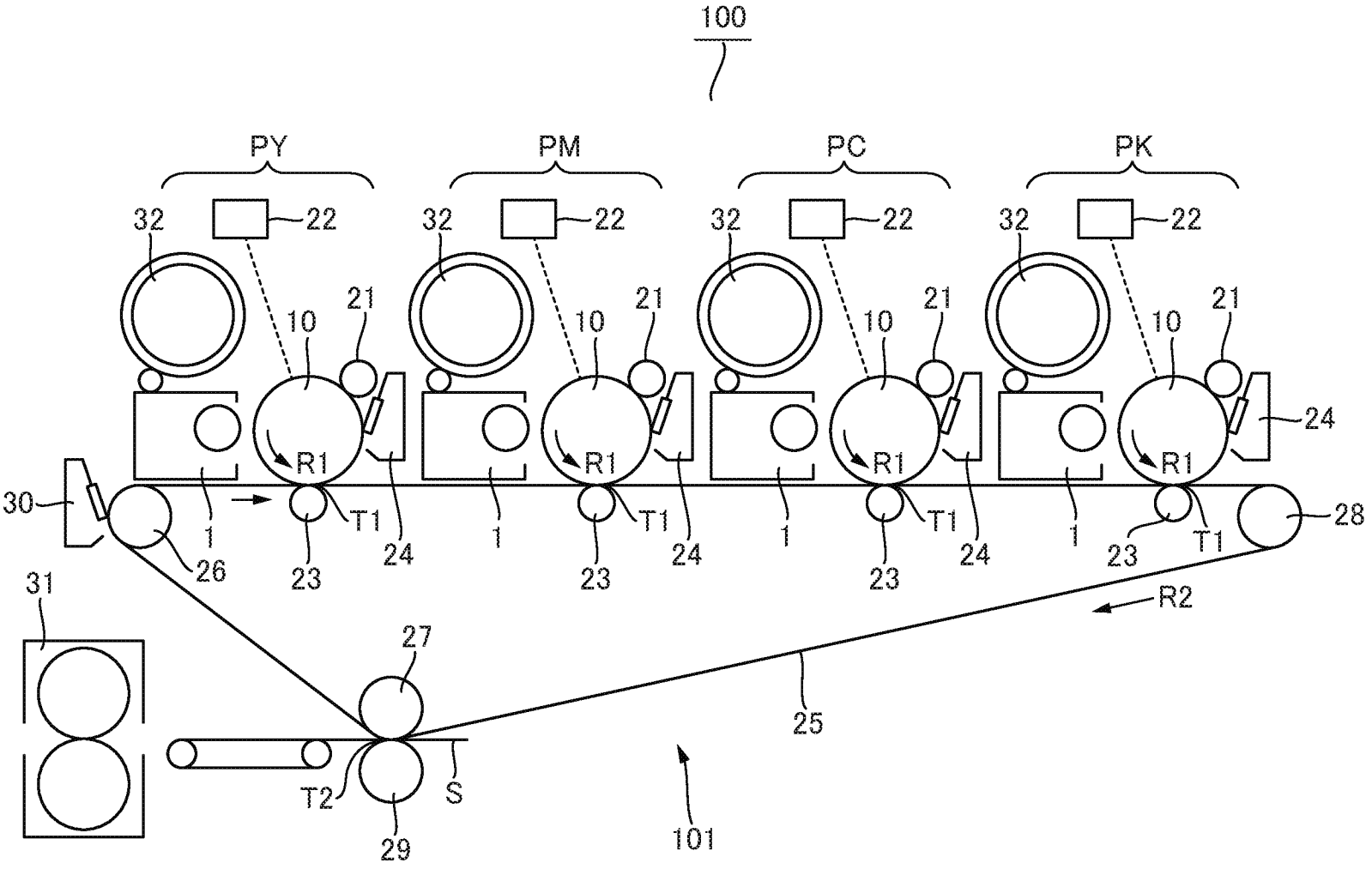
FIG. 1 is a cross-sectional view of an image forming apparatus according to a first embodiment.

FIG. 1 is a schematic drawing illustrating a configuration of an image forming apparatus 100 according to the present embodiment. The image forming apparatus 100 is a full-color printer including a tandem intermediate transfer-type image forming engine 101 in which image forming units PY, PM, PC and PK are arranged along an intermediate transfer belt 25. Examples of recording material include sheet material (hereinafter referred to as sheet S) such as paper, plastic films, cloth and others.

The respective image forming units PY to PK are image forming units adopting an electrophotographic system that form toner images by executing an electrophotographic process. In other words, the image forming unit PY uniformly charges a surface of a photosensitive drum 10 serving as a photosensitive member by a charger 21, and writes an electrostatic latent image on the surface of the drum by a laser beam irradiated from a laser scanner 22. The electrostatic latent image is developed as image by toner supplied from a developing apparatus 1, and a yellow toner image is visualized.

Similar processes are advanced in parallel in other image forming units PM, PC and PK, and toner images of respective colors, which are magenta, cyan and black, are formed. The configurations of the image forming units PY to PK are approximately the same except for the color of the toner being used for developing the image, so respective descriptions are omitted. The toner image borne on the photosensitive drum 10 of each of the image forming units PY to PK is primarily transferred by a primary transfer roller 23 to the intermediate transfer belt 25 at a primary transfer portion T1. A full-color toner image is formed on the surface of the intermediate transfer belt 25 by having toner images of other colors transferred in a superposed manner to the yellow toner image initially transferred to the intermediate transfer belt 25. Attached substances such as residual toner remaining on the photosensitive drum 10 without being transferred to the intermediate transfer belt 25 are removed by a drum cleaner 24.

The intermediate transfer belt 25 serving as an intermediate transfer body is wound around a tension roller 26, a secondary transfer inner roller 27 and a driving roller 28, and driven by the driving roller 28 to be conveyed in a direction of rotation R2 corotating with a direction of rotation R1 of the photosensitive drum 10. A secondary transfer roller 29 is arranged at a position opposed to the secondary transfer inner roller 27 interposing the intermediate transfer belt 25, and a secondary transfer portion T2 is formed as a nip portion between the secondary transfer roller 29 and the intermediate transfer belt 25. A sheet S is fed one at a time to the secondary transfer portion T2 from a cassette or a tray. A toner image borne on the intermediate transfer belt 25 is secondarily transferred to the sheet S by a bias electric field formed at the secondary transfer portion T2. Attached substances such as transfer residual toner remaining on the intermediate transfer belt 25 without being transferred to the sheet S are removed by a belt cleaner 30.

Thereafter, the sheet S is conveyed to a fixing unit 31. The fixing unit 31 includes a pair of rotary bodies that nip and convey the sheet S and a heat source such as a halogen lamp, heating and pressing the toner image while conveying the sheet S. Thereby, toner particles are melted and fixed, and an image fixed to the sheet S is obtained. The sheet S having passed through the fixing unit 31 is discharged to the exterior of the image forming apparatus 100.

A replenishing apparatus 32 is connected to the developing apparatus 1 of each of the image forming units PY to PK. The replenishing apparatus 32 includes a storage container for storing developer for replenishment and a hopper unit for measuring developer discharged from the storage container and replenishing developer to the developing apparatus 1. Developer stored in the storage container contains colored toner corresponding to each of the image forming units PY to PK. As described later, the replenishing apparatus 32 performs operation to replenish developer to the developing apparatus 1 based on a detection signal from a toner density sensor provided on the developing apparatus 1.

The configurations of the developing apparatus 1 and an agitating screw 14 described hereafter are not limited to application of the image forming apparatus including the image forming engine 101 described above and can be applied to an image forming apparatus adopting a method where toner image is directly transferred from the photosensitive member to the recording material.

Developing Apparatus

Figure 2:
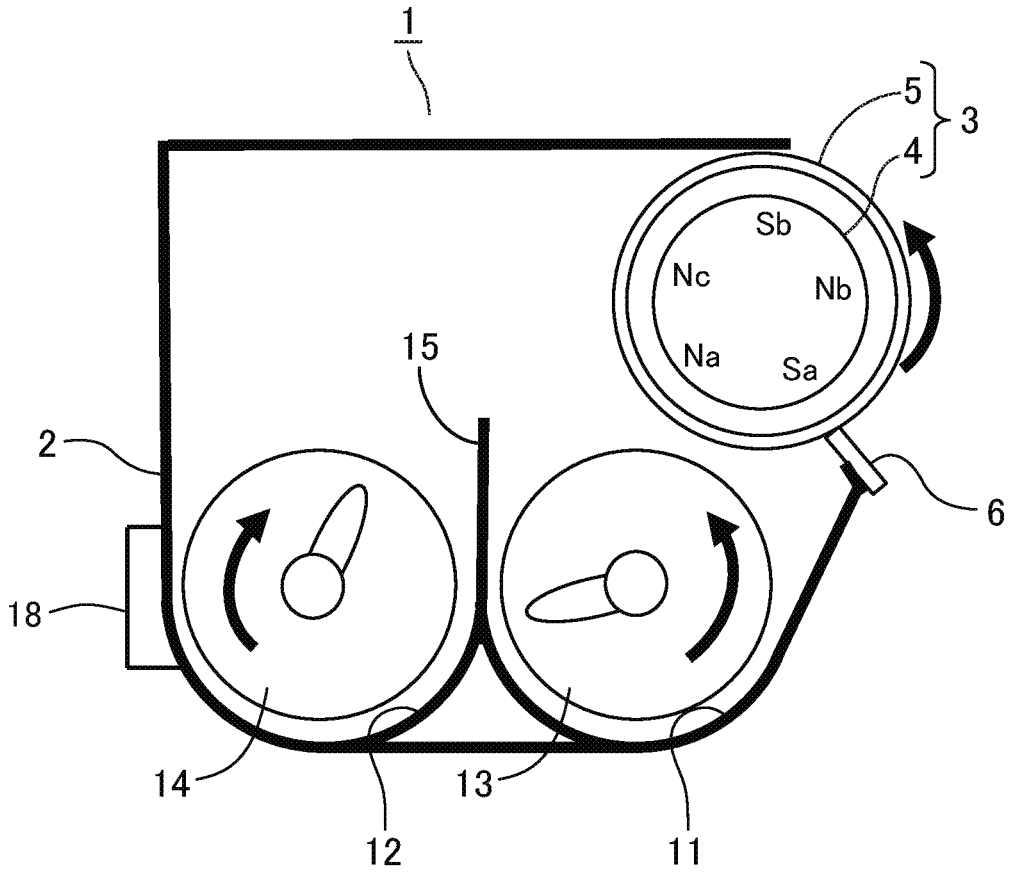
FIG. 2 is a cross-sectional view of a developing apparatus according to the first embodiment.
Figure 3:
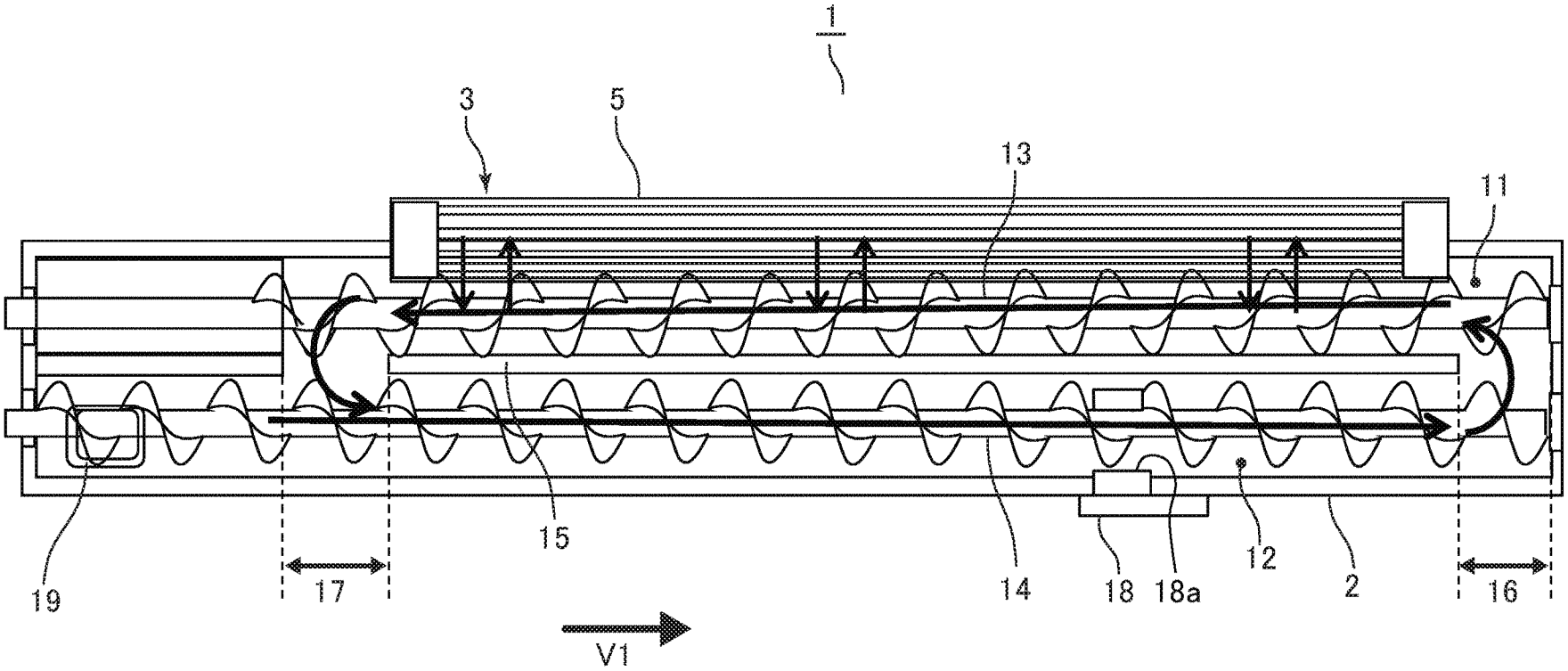
FIG. 3 is a vertical cross-sectional view of the developing apparatus according to the first embodiment.

The developing apparatus 1 according to the present embodiment will be described with reference to FIGS. 2 and 3. FIG. 2 is a cross-sectional view illustrating the developing apparatus 1 cut at a plane perpendicular to a longitudinal direction, i.e., axial direction of the photosensitive drum 10, and FIG. 3 illustrates a state where an inner side of the developing apparatus 1 is viewed from above.

As illustrated in FIG. 2, the developing apparatus 1 includes a developer container 2 storing, i.e., accommodating, developer, a developing roller 3 composed of a developing sleeve 5 and a magnet roller 4, a blade 6, a developing screw 13, an agitating screw, i.e., conveyance screw, 14, and an inductance sensor 18. The developing sleeve 5 is a developer bearing member that bears developer. The agitating screw 14 agitates and conveys the developer.

A developing chamber 11 that supplies developer to the developing sleeve 5 and an agitating chamber 12 that constitutes a circulation path of developer with the developing chamber 11 are provided in the developer container 2. The developing chamber 11 and the agitating chamber 12 are spatially partitioned by a partition member 15 serving as a partition wall.

The developing roller 3 is composed of a cylindrical magnet roller 4 fixed to the developer container 2 and the developing sleeve 5 that rotates on the circumference of the magnet roller 4. The magnet roller 4 serving as a magnetic field generating unit includes magnetic poles Na, Nb, Nc, Sa and Sb positioned at a plurality of positions in the circumferential direction. The developing sleeve 5 is driven to rotate in the direction of the arrow in the drawing, conveying developer attracted at a position corresponding to an attraction pole Na toward a developing area where the developing roller 3 and the photosensitive drum 10 are opposed to one another. The blade 6 is a doctor blade that regulates the thickness of developer raised in a state of a magnetic brush near a magnetic pole Sa arranged between the attraction pole Na and a developing pole Nb, and controls the amount of developer reaching the developing area.

The developer having reached the developing area forms a magnetic brush in a state where carrier is aligned in the radial direction of the developing roller 3 by the magnetic field generated by the developing pole Nb. In this state, toner particles fly toward the photosensitive drum according to bias voltage applied to the developing sleeve 5 and potential distribution on the drum surface. Thereby, charged toner particles are supplied to the photosensitive drum and the electrostatic latent image on the drum surface is visualized as toner image. After developing an image, the developer is peeled from the developing sleeve 5 at a non-magnetic band between the peeling pole Nc and the attraction pole Na and returned to the developing chamber 11.

The present embodiment adopts two-component developer, and the developer stored in the developer container 2 contains nonmagnetic toner having negative charged polarity and magnetic carrier having positive charged polarity. Nonmagnetic toner is formed, for example, by encapsulating coloring agent and wax component in resin such as polyester and styrene-acrylic resin, which is powdered by pulverization or polymerization, and adding fine powder such as titanium oxide and silica on a surface thereof. Magnetic carrier is formed by applying a resin coating on a surface layer of a core of ferrite particles or a core of resin particles kneaded with magnetic powder. According to the present embodiment, toner density of new developer in an initial state which has not yet been used for developing image, i.e., ratio of weight of toner in total weight of developer, abbreviated as TD ratio, is set to 10%.

The developing apparatus 1 is configured to replenish toner from the replenishing apparatus 32 described above to compensate for the reduction of toner density accompanying consumption of toner by developing image. A replenishing port 19 (refer to FIG. 3) which is an opening portion that communicates the agitating chamber 12 and the exterior of the developing apparatus 1 is provided on the developer container 2. The replenishing apparatus 32 replenishes toner to the developing apparatus 1 through the replenishing port 19.

In the developer container 2, as illustrated in FIG. 3, the developer is agitated by the developing screw 13 and the agitating screw 14 and circulated in the developing chamber 11 and the agitating chamber 12. A first communication port 16 that allows developer to flow from the agitating chamber 12 to the developing chamber 11 and a second communication port 17 that allows developer to flow from the developing chamber 11 to the agitating chamber 12 are provided on the partition member 15. The replenishing port 19 is arranged upstream of the second communication port 17 in a conveyance direction V1 of developer in the agitating chamber 12. Toner falling through the replenishing port 19 into the agitating chamber 12 is mixed with surrounding developer by the agitating operation of the agitating screw 14 and the developing screw 13 while being conveyed. Thereby, the toner density within the developer container 2 is uniformized, and developer having toner and carrier in a frictionally-electrified state is supplied to the developing sleeve 5.

The developing apparatus 1 according to the present embodiment adopts a so-called ACR (Auto Carrier Refresh) technique where a small amount of developer is gradually discharged from the developer container 2 while developer containing carrier is replenished from the replenishing apparatus 32, such that the carrier in the developer container is gradually replaced. Generally, the developing system using two-component developer characterizes in that less stress is applied to the toner compared to the developing system using a one-component developer composed of magnetic toner. Since the carrier in the developer has greater surface area than toner, contamination of carrier caused by toner being attached to the surface of the carrier does not appear in the initial state. However, after long-term use, contamination caused by toner attaching to the carrier surface is increased, and thereby, the performance of carrier for charging toner is gradually deteriorated. As a result, problems such as fogging, which is an image defect caused by toner having a small amount of charge being attached slightly to a white base part or toner scattering may occur. It may be possible to increase the amount of carrier stored in the developer container 2 to extend the life of the developing apparatus 1, but this method may not be preferable since it may lead to increasing the size of the developing apparatus.

Actually, the developing apparatus 1 adopting the ACR configuration is equipped with a discharge port for discharging developer from the developer container 2. The discharge port is provided at a predetermined height with respect to a bottom surface of the developing chamber 11 or the agitating chamber 12, and developer is discharged as excessive developer through the discharge port when a surface level of developer in the container exceeds a predetermined height. In a state where the amount of carrier replenished from the replenishing apparatus 32 is balanced with the amount of carrier discharged from the discharge port, an average value of accumulated periods of use of carrier particles stored in the developer container 2 is converged to a fixed value. In other words, a configuration is adopted where bulk density fluctuation of developer stored in the developing apparatus 1 is used to discharge excessive deteriorated developer and maintain the bulk density level of developer within the developing apparatus 1 to an approximately constant level. Thereby, the deteriorated carrier within the developing apparatus 1 is gradually replaced with new carrier and the charging performance of carrier can be maintained roughly constantly, contributing to improving the stability of image quality.

Inductance Sensor

The inductance sensor 18 serving as a toner density detection sensor according to the present embodiment will be described. The inductance sensor 18 is a sensor that detects information related to permeability of developer, and it is attached to the developer container 2 in a state where a sensor surface 18*a* for detecting permeability is protruded into the agitating chamber 12 in a state opposed to the agitating screw 14. That is, the inductance sensor 18 is arranged opposed to a portion in the circumferential direction of the agitating screw 14 and detects information related to toner density of developer stored in the developer container 2.

The inductance sensor 18 is arranged so that the sensor surface 18*a* is sufficiently close to the agitating screw 14 to prevent developer from accumulating near the sensor surface 18*a*. The present inventors have confirmed that if the distance between the sensor surface 18*a* and the outer circumferential surface of the agitating screw 14 is referred to as Q the value of distance G should preferably be in the range of 0.2 to 2.5 [mm] from the viewpoint of sensor sensitivity. However, if the inductance sensor 18 becomes too close to the agitating screw 14, the sensor surface 18*a* may contact the blade of the agitating screw 14. In that case, undesirable effects may appear, such as mixing of chipped substances created by deformation or damaging of the inductance sensor 18 or aggregation of developer sandwiched between the sensor surface 18*a* and the blades, which may lead to deterioration of developed image. In view of the result of investigation described above, the distance G is set to 0.5 [mm] according to the present embodiment.

The inductance sensor 18 detects permeability within a predetermined detection range from the sensor surface 18*a*, so that even if the toner density of developer is constant, the detected permeability varies along with the rotation of the agitating screw 14. Specifically, developer passes the area near the sensor surface 18*a* of the inductance sensor 18 along with the rotation of the agitating screw 14, so that the detected value of permeability shows a waveform in which maximum values and minimum values repeatedly appear periodically in response to the rotation cycle of the agitating screw 14. In the present embodiment, detection of permeability of developer by the inductance sensor 18 is performed every 10 ms. A value obtained by averaging the detection values measured every 10 ms by a predetermined time defined by an interval from a certain maximum value to another maximum value of the waveform, in other words, time required for the agitating screw 14 to rotate once by the rotational speed, is set as the detection value of permeability at a certain time.

Figure 4:
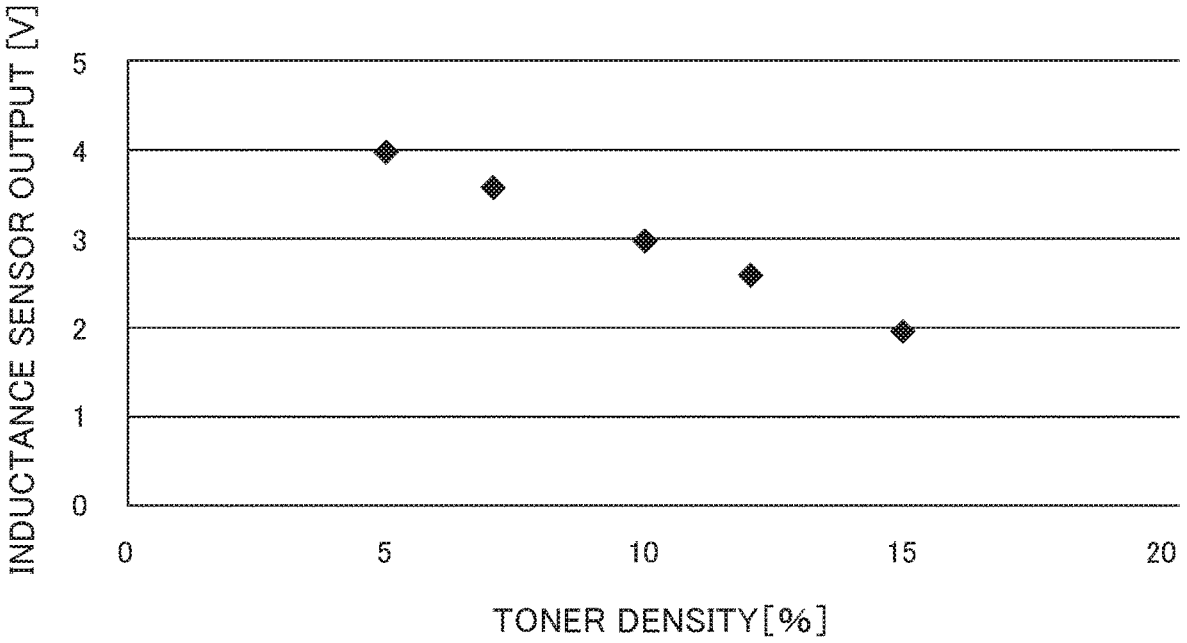
FIG. 4 is a graph illustrating a relationship between toner density and inductance sensor output in the developing apparatus according to the first embodiment.

The two-component developer used in the present embodiment contains magnetic carrier and nonmagnetic toner as main components. If the toner density of developer, that is, ratio of weight of toner particles to the total weight of carrier particles and toner particles, is varied, the ratio occupied by the carrier serving as magnetic particles is varied so that the permeability of developer is also varied. The variation of permeability is detected by the inductance sensor 18. As illustrated in FIG. 4, the electric signal output by the inductance sensor 18 varies approximately linearly according to toner density. That is, the value of the signal output from the inductance sensor 18 corresponds to the toner density of two-component developer stored in the developing apparatus 1.

Figure 5:
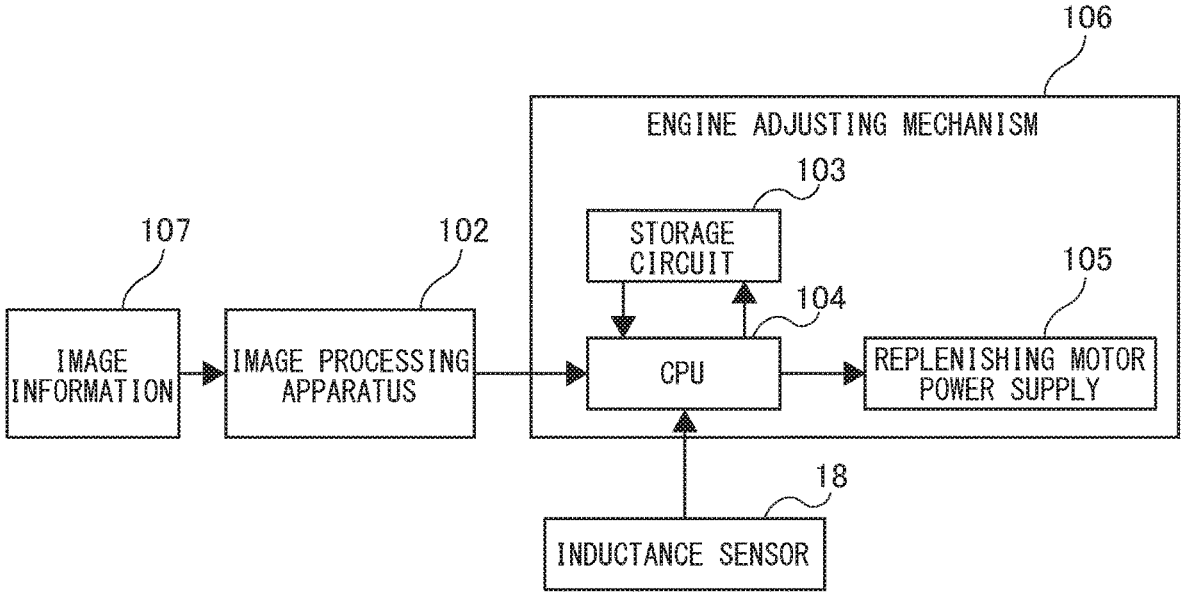
FIG. 5 is a block diagram illustrating a circuit configuration for processing output signals from the inductance sensor of the image forming apparatus according to the first embodiment.

Next, the circuit configuration for processing output signals from the inductance sensor 18 is described with reference to the block diagram of FIG. 5. The image forming apparatus 100 (refer to FIG. 1) includes an image processing apparatus 102 and an engine adjusting mechanism 106. As illustrated in FIG. 5, the image processing apparatus 102 analyzes an image information 107 transmitted to the image forming apparatus 100 from an external device and generates image data of a format processable by the engine adjusting mechanism 106. The engine adjusting mechanism 106 is a control unit that controls the image forming engine 101 (refer to FIG. 1) and includes a CPU (Central Processing Unit) 104, a storage circuit 103 and a replenishing motor power supply 105. The CPU 104 accesses the storage circuit 103 including a non-transitory storage medium to read and execute programs and controls the operations of various units of the image forming engine 101. For example, if the image information 107 and a command to form an image is transmitted from an external device to the image forming apparatus 100, the image processing apparatus 102 generates image data based on the image information 107 and outputs the image data to the engine adjusting mechanism 106. The CPU 104 having received image data from the image processing apparatus 102 executes an image forming operation by a process of sending data having expanded a single-color image of each color in a sub-scanning direction and a main scanning direction as video signal to the laser scanner 22 of each of the image forming units PY to PK.

The signal output from the inductance sensor 18 is transmitted to the CPU 104. Then, a measurement value of toner density calculated from the output signal of the inductance sensor 18 is compared with a predetermined density value, that is, toner density value stored in the storage circuit 103 as an initial setting value, at the CPU 104. In this state, when the toner density is detected as described above, the detected permeability is varied along with the movement of the agitating screw 14. Therefore, the measurement value of toner density is calculated by obtaining a value having averaged the output signals of the inductance sensor 18 that varies periodically along with the rotation of the agitating screw 14 by the above-described method and converting the averaged value into toner density using the correlation illustrated in FIG. 4.

General Conveyance Screw

Figure 6:
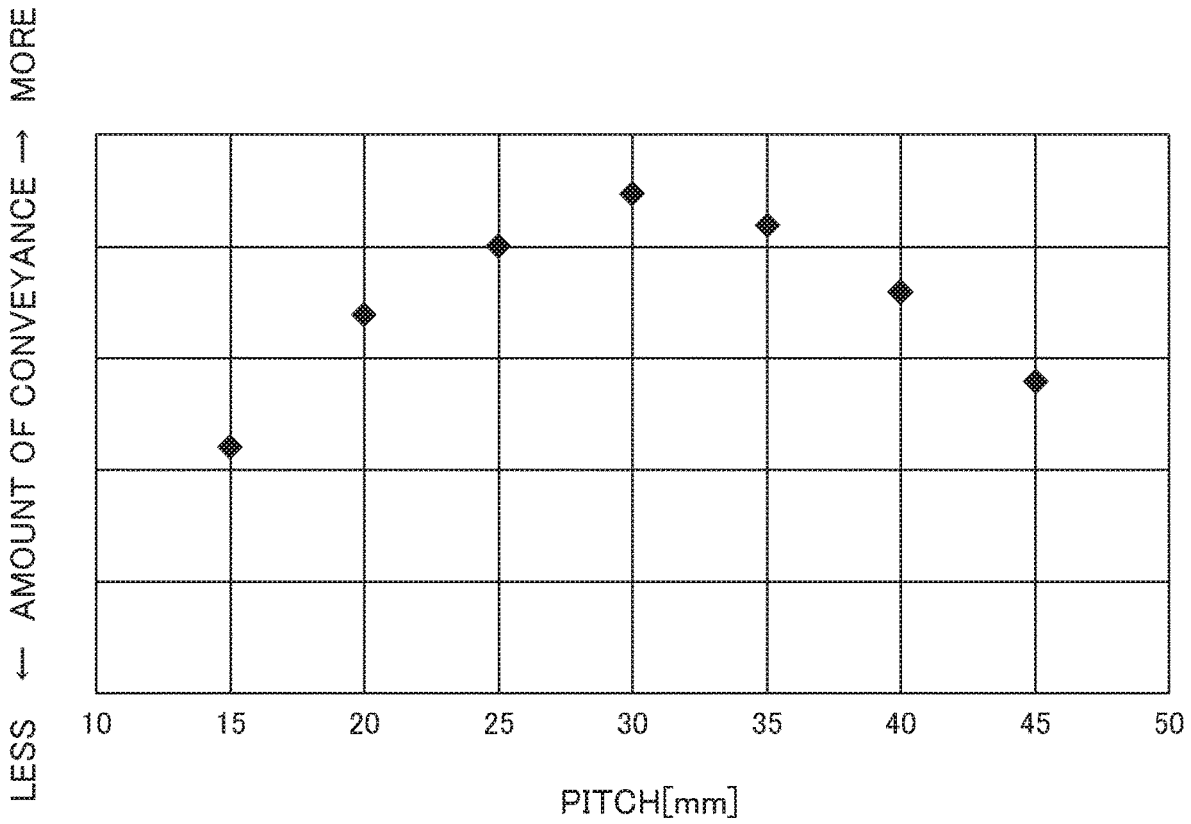
FIG. 6 is a graph illustrating a relationship between a pitch of a helical blade of a general conveyance screw and an amount of conveyance of developer.
Figure 7:
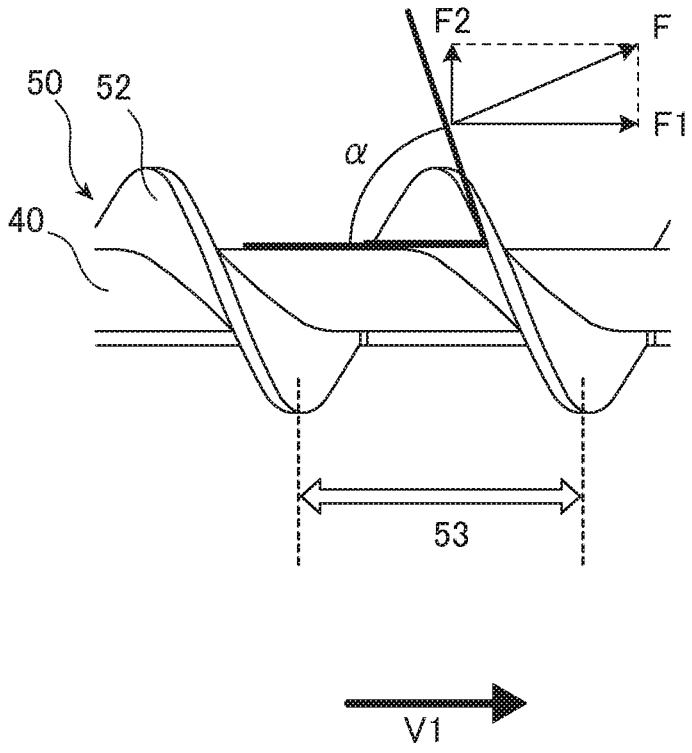
FIG. 7 is a side view illustrating a relationship between the pitch of a helical blade of a general conveyance screw and the amount of conveyance of developer.

Next, prior to describing the configuration of the agitating screw 14, a general relationship between conveyance screw pitch and conveyance performance will be described with reference to FIGS. 6 and 7. FIG. 6 is a graph illustrating the relationship between a helical blade pitch of the conveyance screw and amount of conveyance of developer per rotation, and it illustrates a result of measurement using a one-row screw having an outer diameter of 14 [mm] as an example of the conveyance screw. The amount of conveyance of developer per rotation varies according to the pitch of the screw member. As illustrated in FIG. 6, normally, the amount of conveyance of developer per rotation is illustrated by a graph that is curved in a convex toward the upper direction with respect to the conveyance screw pitch. In the case of this conveyance screw, the amount of conveyance of developer per rotation becomes greatest when the pitch is 30 [mm]. However, the shape of the graph illustrated in FIG. 6 will vary if the outer diameter of the screw member is varied, so that the applicable pitch of the present embodiment is not limited to this example.

The reason why such phenomenon is observed will be described with reference to FIG. 7. A conveyance screw 50 includes a screw shaft, serving as shaft portion, 40 and a helical blade 52. A pitch 53 is a length in an axial direction, that is, conveyance direction V1 of developer, of the blade 52 turning once around the screw shaft 40. If it is assumed that all developer present within one pitch of the blade 52 is moved along with the apparent movement of the blade 52 accompanying the rotation of the screw shaft 40, the distance in which the developer advances during one turn of the conveyance screw 50 is equivalent to the pitch 53. Actually, however, some developer slides on the surface of the blade 52 during movement, so that not all the developer is conveyed along with the blade 52.

If the pitch 53 is gradually widened, an angle α of the blade 52, that is, an angle in which a helix formed by an outer end portion in the radial direction of the blade 52 crosses the rotational axis of the screw when viewed in a direction perpendicular to the axial direction, becomes small. Then, a component F2 toward an outer radial direction contained in a normal vector F of a conveyance surface of the blade 52 increases while a component F1 parallel to the axial direction reduces. Therefore, if the pitch 53 is too wide, most of the rotational energy of the conveyance screw 50 will be consumed by the blade 52 pushing the developer outward in the radial direction, and the ability of conveying the developer along the axial direction is relatively reduced. That is, if the angle α becomes too small, the amount of developer jumping in the perpendicular direction with respect to the screw shaft 40 is increased and the amount of developer conveyed in the conveyance direction V1 of the screw shaft 40 is reduced in correspondence therewith. Meanwhile, if the pitch 53 is too narrow, the angle α is increased so that the blade 52 may effectively move the developer in the axial direction, but since the amount of movement of the blade 52 per rotation in the axial direction is small, the conveyance performance is deteriorated. As a result, as illustrated in FIG. 6, a convex-shaped curve is observed where the conveyance performance becomes maximum if the pitch 53 is set to an appropriate value.

Agitating Screw

Now, a general configuration of the agitating screw 14 according to the present embodiment will be described with reference to FIGS. 8 and 9. The present embodiment adopts, as the agitating screw 14, a multirow screw in which multiple rows of helical blades are provided, that is, in which a plurality of blades is present in a cross section perpendicular to the axial direction. The multirow screw has multiple rows of helical blades, so that the number of blades passing a point near the screw when the screw turns once increases, and as a result, the conveyance performance of developer is known to be increased. That is, in the case of a one-row screw, even if the angle α of the blade 52 is set to an appropriate value as described above (refer to FIG. 7), the developer slides on the conveyance surface of the blade 52 and limits the conveyance performance, whereas in the case of a screw having multiple rows of blades, the conveyance performance is improved. Further, by adopting a multirow screw, the number of agitating operations received by the developer in the agitating chamber 12 (refer to FIG. 3) when the screw turns one is increased, so that the agitation performance of the agitating screw 14 can be improved. The agitation performance refers to an ability to rub toner and carrier against each other to cause frictional electrification and an ability to uniformize the toner density speedily by mixing the toner replenished through the replenishing port 19 (refer to FIG. 3) with surrounding developer. For example, two to four rows of blades can be adopted as the multiple rows of blades.

Figure 8:
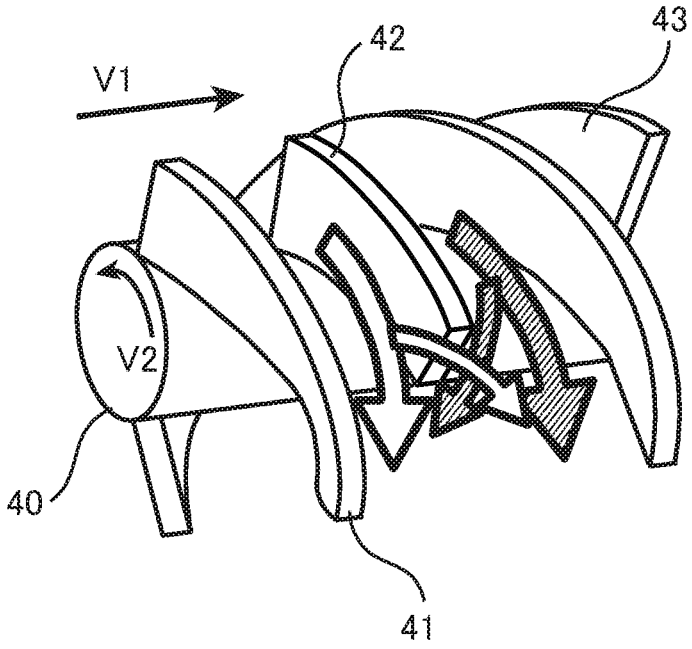
FIG. 8 is a perspective view illustrating a major portion of an agitating screw according to the first embodiment.
Figure 9:
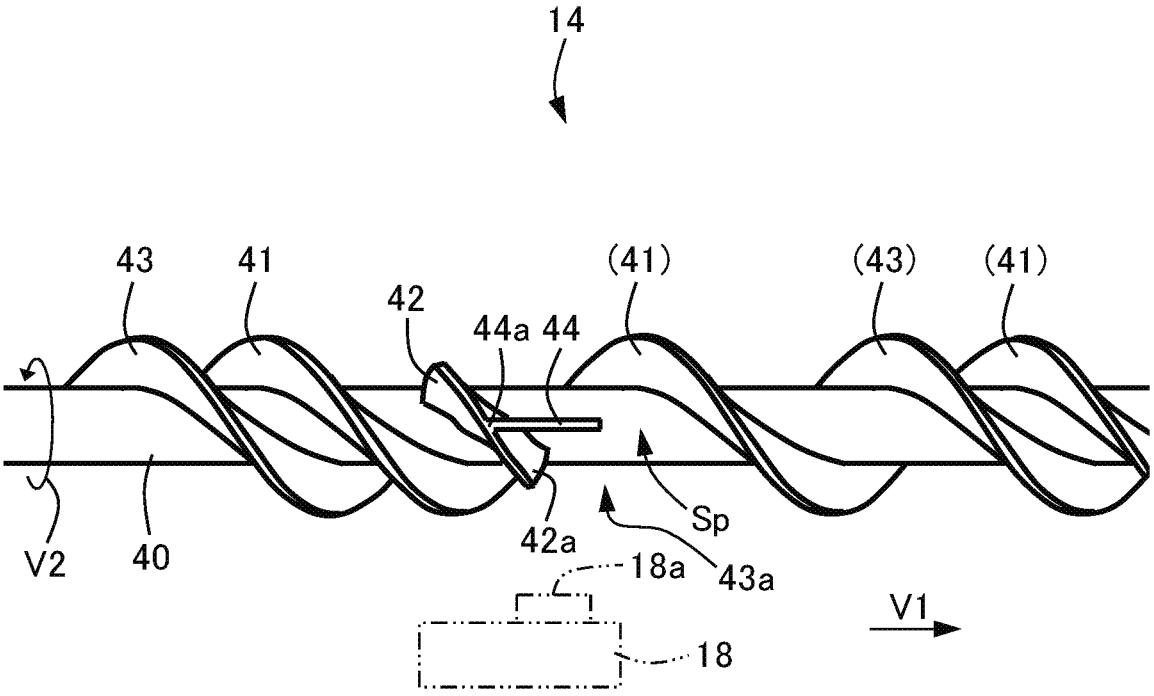
FIG. 9 is a side view illustrating a major portion of the agitating screw according to the first embodiment.

According to the present embodiment, as illustrated in FIGS. 8 and 9, the agitating screw 14 adopts a three-row screw as the multirow screw. Therefore, the agitating screw 14 includes the screw shaft 40, a first blade portion 41 serving as a first row of screws, a second blade portion 42 serving as a second row of screws, and a third blade portion 43 serving as a third row of screws. The agitating screw 14 is formed by injection molding a plastic material. The screw shaft 40 is provided rotatably on the developer container 2 (refer to FIG. 3). The first blade portion 41, the second blade portion 42 and the third blade portion 43 are arranged in order in the conveyance direction V1.

The first blade portion 41, the second blade portion 42 and the third blade portion 43 all have helical shapes in the same direction with the same pitch, which rotate integrally with the screw shaft 40 and convey developer stored in the developer container 2 in the conveyance direction V1 by rotation. The first blade portion 41, the second blade portion 42 and the third blade portion 43 are arranged with their phases varied. That is, when a cross-section including the second blade portion 42 orthogonal to the axial direction is viewed in the axial direction, the second blade portion 42 has a phase that differs from the first blade portion 41 in the circumferential direction. In the present embodiment, a state in which phases of blade portions differ refers to a state where the positions of blade portions differ when the agitating screw 14 is viewed in the rotational axis direction. In the present embodiment, the first blade portion 41, the second blade portion 42 and the third blade portion 43 are arranged with phases respectively deviated by 120° from the adjacent blade portions. The present embodiment has illustrated a case where the first blade portion 41, the second blade portion 42 and the third blade portion 43 are arranged with phases respectively deviated by 120° from the adjacent blade portions, but the present embodiment is not limited to this example, and they can be deviated by other angles.

The second blade portion 42 of the three rows of blades adopts a configuration where the blade is discontinuous in a longitudinal direction in the conveyance direction V1 of developer with respect to the screw shaft 40 in a vicinity of the inductance sensor 18 (refer to FIG. 3). That is, as illustrated in FIG. 8, the present embodiment adopts a configuration where at least one of the rows of the multirow screw, which in the present example is the second blade portion 42, includes a cutout portion, that is, a gap portion where an outer edge portion in the radial direction of the blade is discontinuous. The second blade portion 42 adopts a same pitch length and same outer diameter as the first blade portion 41.

As illustrated in FIGS. 8 and 9, a discontinuous blade area of the second blade portion 42 is defined as a portion where an area with a blade and an area without a blade exist in a mixture within one turn, or 360°, of the blade, wherein the present embodiment adopts a configuration where the area with the blade and the area without the blade are alternately arranged every 90°. The third blade portion 43 includes a cutout portion 43*a* which is a gap portion where the blade is not formed in a vicinity of the second blade portion 42 and a rib 44 described later. Therefore, the first blade portion 41 is positioned to oppose to the second blade portion 42 on both upstream and downstream sides in the conveyance direction V1. In the present embodiment, the screw shaft 40 has a diameter of 6 [mm], and the first blade portion 41, the second blade portion 42 and the third blade portion 43 all have a screw pitch of 30 [mm].

By providing the second blade portion 42, developer having been divided by other blade portions merge in the conveyance direction V1 at the cutout portion in the circumferential direction of the second blade portion 42, and the developer is agitated effectively in a manner being sheared by the second blade portion 42. In other words, in a state where the screw shaft 40 rotates in the V2 direction, the developer existing on one side of the second blade portion 42 (white arrow) and the developer existing on the other side (black arrow) merge and are mixed with each other at the cutout portion in the circumferential direction of the second blade portion 42. Thereafter, the developer is separated again by the portion of the second blade portion 42 where the cutout is not formed. Such merging and separating of developer is repeatedly performed by the rotation of the screw shaft 40 by which the developer is agitated efficiently, and for example, toner replenished through the replenishing port 19 (refer to FIG. 3) is mixed speedily with the surrounding developer. Further, since the conveyance path of developer is split, replenished toner will be distributed widely throughout the developer when toner is replenished. In other words, the agitation property of replenished toner in developer can be improved by the replenished toner being distributed speedily in the developer.

Figure 10A:
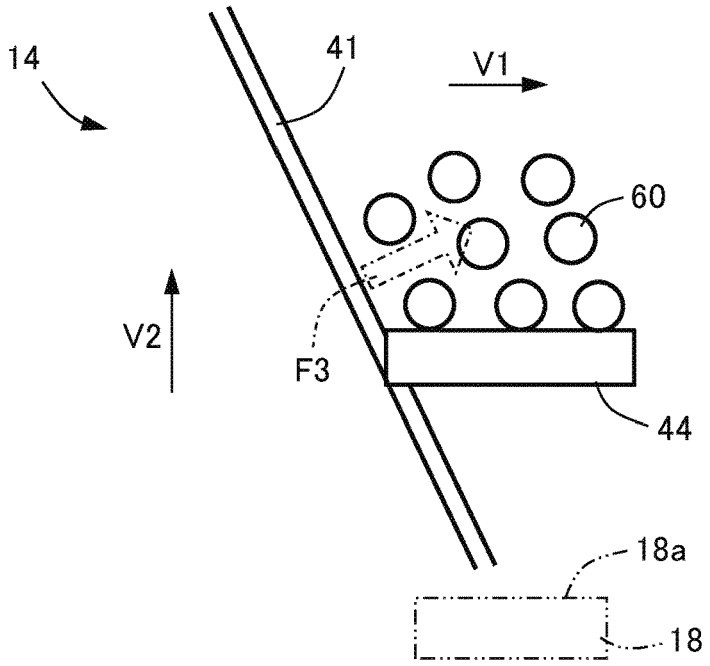
FIG. 10A is a schematic side view illustrating a state in which a rib of a general agitating screw is formed continuously to the first blade portion and the screw is rotated at high speed.
Figure 10B:
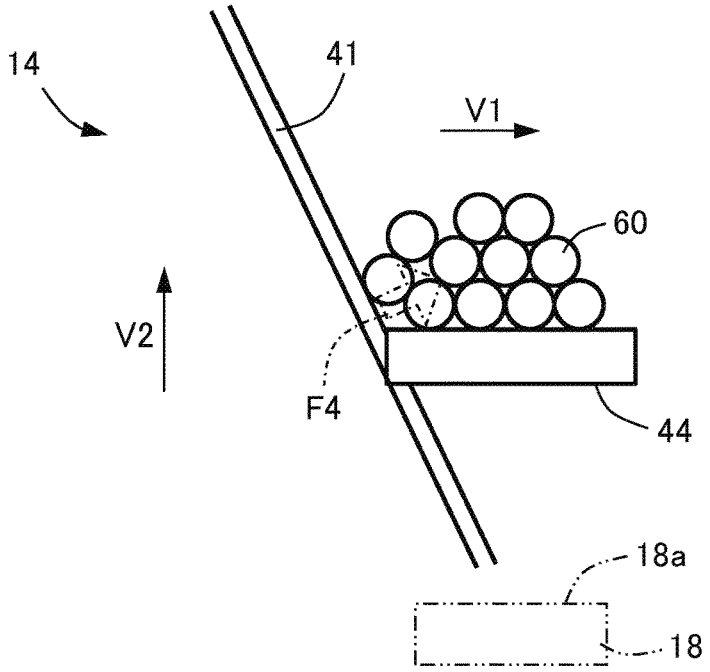
FIG. 10B is a schematic side view illustrating a state in which the rib of the general agitating screw is formed continuously to the first blade portion and the screw is rotated at low speed.

Now, a general configuration of the agitating screw 14 near the inductance sensor 18 will be described with reference to FIGS. 10A and 10B. The rib 44 is provided on the agitating screw 14 at a position opposed to the inductance sensor 18 so as to be arranged in parallel with the screw shaft 40. That is, the rib 44 is disposed to protrude toward the radial direction at a position opposed to the inductance sensor 18 from the screw shaft 40. The rib 44 has a function to accumulate developer 60 at an area opposed to the sensor surface 18*a* which is a detection area of the inductance sensor 18 and to scrape off the developer 60 near the inductance sensor 18. In order to accumulate the developer 60 at the detection area of the inductance sensor 18, it is necessary that a sufficient amount of developer 60 is sent upstream of a direction of rotation V2 of the rib 44. Therefore, it may be possible to provide the rib 44 arranged in the vicinity of the agitating screw 14 continuously to the first blade portion 41 of the agitating screw 14, for example. Since the rib 44 does not have the power to convey the developer 60 in the conveyance direction V1, the developer 60 conveyed by the agitating screw 14 stays as it is at the rib 44. Therefore, the developer 60 is accumulated upstream of the rib 44, and it becomes possible to ensure the developer 60 required to perform toner density detection by the inductance sensor 18.

However, according to a general configuration where the rib 44 is provided continuously to the first blade portion 41 formed in a continuous helical shape, the bulk density of the developer 60 on the rib 44 may vary if the rotational speed of the agitating screw 14 changes. The movement of the developer 60 in this case will be described based on the model illustrated in FIGS. 10A and 10B. As illustrated in FIG. 10A, if the rotational speed of the agitating screw 14 is high, a force F3 in which the developer 60 is conveyed in the conveyance direction V1 of the agitating screw 14 is great. Therefore, the developer 60 positioned on the rib 44 will be conveyed in the conveyance direction V1 without being accumulated on the rib 44 by the force in which the developer is conveyed to the first blade portion 41. Meanwhile, as illustrated in FIG. 10B, if the rotational speed of the agitating screw 14 is low, a force F4 in which the developer 60 is conveyed in the conveyance direction V1 of the agitating screw 14 is smaller than the force F3, so that the developer 60 will keep on accumulating on the rib 44 compared to the case where the rotational speed is high. Therefore, there was a drawback in that if the rotational speed is low, the developer 60 remaining on the rib 44 will increase the bulk density by the compression effect applied by the rib 44, and as a result, the detection value of the inductance sensor 18 was increased.

Figure 11A:
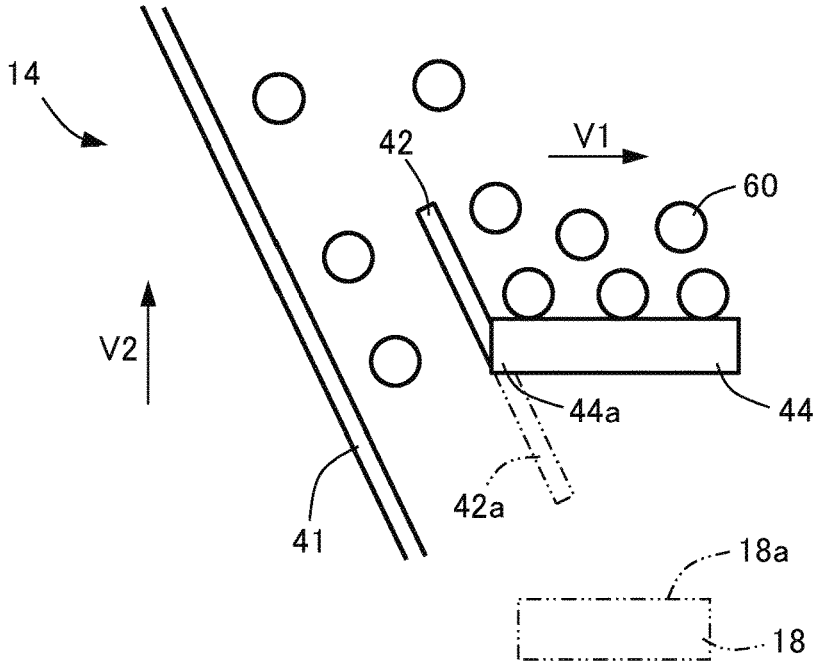
FIG. 11A is a schematic side view illustrating a state in which the rib of the agitating screw according to the first embodiment is formed continuously to the second blade portion and the screw is rotated at high speed.
Figure 11B:
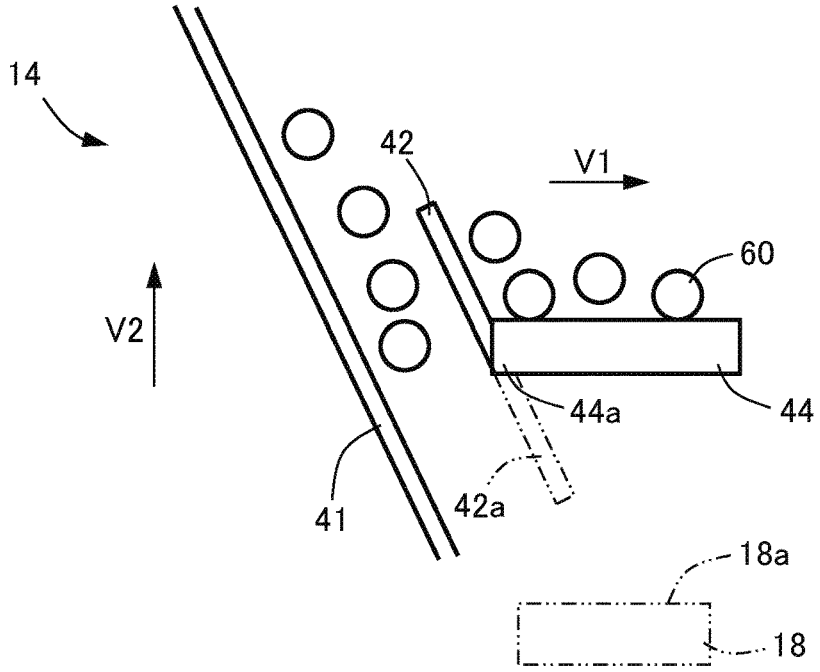
FIG. 11B is a schematic side view illustrating a state in which the rib of the agitating screw according to the first embodiment is formed continuously to the second blade portion and the screw is rotated at low speed.

According to the present embodiment, a discontinuous second blade portion 42 is provided continuously to the rib 44 as illustrated in FIGS. 11A and 11B to solve the problems mentioned above. That is, the second blade portion 42 has a helical shape and arranged continuously to an upstream end portion 44*a* of the rib 44 with respect to the conveyance direction V1, and the length of the second blade portion 42 from the upstream end portion 44*a* of the rib 44 to a downstream side in the direction of rotation V2 of the agitating screw 14 is not more than one-third of a length of a turn. Thereby, the variation of bulk density of the developer 60 accumulated on the rib 44 on the agitating screw 14 due to different rotational speeds of the agitating screw 14 as described earlier can be suppressed. In the present embodiment, the length of the second blade portion 42 being not more than one-third of a turn means that when viewed in a cross section orthogonal to the rotational axis of the agitating screw 14, the first blade portion 41 is formed across one whole turn, i.e., 360°, of the agitating screw 14 around the screw shaft 40, whereas the second blade portion 42 is formed to cover not more than one-third, i.e., 120°, of the agitating screw 14 around the screw shaft 40. That is, the second blade portion 42 is formed to extend not more than one-third of a turn from the upstream end portion 44*a* of the rib 44 to a downstream side in the direction of rotation V2 of the agitating screw 14 when viewed in the axial direction of the agitating screw 14. The present embodiment illustrates a case where the second blade portion 42 has a helical shape, but the present embodiment is not limited to this example. The second blade portion 42 should merely be shaped to convey the developer in the conveyance direction V1 by rotation, so that for example, it may be a plate-like rib or a blade having a planar surface arranged in an inclined angle with respect to the conveyance direction, for example.

According to the present embodiment, the height of the rib 44 from the screw shaft 40 is the same as the height of the first blade portion 41 from the screw shaft 40. Therefore, the rib 44 is prevented from being in contact with the sensor surface 18*a* of the inductance sensor 18. However, the height of the rib 44 from the screw shaft 40 is not necessarily the same as the height of the first blade portion 41 from the screw shaft 40. For example, in a state where the height of the first blade portion 41 from the screw shaft 40 is defined as 100%, the height of the rib 44 can be set to be in the range between 88% or more and 107% or less from the screw shaft 40. If the height of the first blade portion 41 from the screw shaft 40 is set to 100% and the distance between the rib 44 and the sensor surface 18*a* of the inductance sensor 18 is 0.5 [mm], the following is realized. In this case, for example, the height of the rib 44 should be set to have a difference within 0.5 [mm] to the height of the first blade portion 41, and the distance between the rib 44 and the sensor surface 18*a* of the inductance sensor 18 should be 0.2 [mm] or greater. In order to satisfy this condition, the height of the first blade portion 41 should be between 3.5 and 4.3 [mm].

In the present embodiment, a magnet is provided on the rib 44, but the magnet can be omitted. Further according to the present embodiment, the second blade portion 42 is formed continuously to the rib 44, but the term "continuously" used in the present specification is not limited to mean a state where the second blade portion 42 and the rib 44 are physically completely connected. For example, even if there is an extremely narrow gap or cutout provided between the second blade portion 42 and the rib 44 which is so narrow that developer cannot easily pass through, the second blade portion 42 and the rib 44 are assumed to be arranged continuously.

The operation of a case where the rib 44 and the second blade portion 42 are arranged continuously will be described with reference to the model illustrated in FIGS. 11A and 11B. The developer 60 is sent to the discontinuous second blade portion 42 from the first blade portion 41 arranged upstream of the second blade portion 42 in the conveyance direction V1 and agitated by the second blade portion 42. The second blade portion 42 itself has conveyance force, so that the developer 60 on the second blade portion 42 is conveyed as it is to the conveyance direction V1. As illustrated in FIG. 11A, in a state where the rotational speed of the agitating screw 14 is high, the developer 60 temporarily stays on the rib 44 but the developer 60 is conveyed as it is to the conveyance direction V1 of the agitating screw 14. This is similar to the case illustrated in FIG. 10A where the rib 44 is connected to the first blade portion 41 arranged continuously. Meanwhile, in a state where the rotational speed of the agitating screw 14 is low as illustrated in FIG. 11B, the conveyance force of the agitating screw 14 is reduced, so that the amount of developer 60 staying on the discontinuous second blade portion 42 is reduced. Therefore, even in a case where the rib 44 is formed continuously to the discontinuous second blade portion 42, the amount of developer 60 staying on the rib 44 is reduced, and compression caused by the increased amount of developer 60 staying on the rib 44 is suppressed. Even if the rotational speed of the agitating screw 14 is low, it becomes possible to suppress the bulk density of the developer 60 on the rib 44 from being increased. Therefore, even if the rotational speed of the agitating screw 14 is changed from high speed to low speed or from low speed to high speed, the detection result of toner density by the inductance sensor 18 is stabilized and suppressed from being dispersed.

In the present embodiment, as illustrated in FIG. 9, a gap Sp is provided at a downstream end portion of the rib 44 in the conveyance direction V1 so that the rib 44 and the blade portion are not in contact with each other. In other words, the rib 44 has the gap Sp formed between the rib 44 and the first blade portion 41 positioned adjacent to and downstream of the rib 44 in the conveyance direction V1. If the rib 44 is to be in contact with the first blade portion 41 at the downstream end portion of the rib 44 in the conveyance direction V1, the developer is blocked from being conveyed in the conveyance direction V1 in this area, so that the conveyance property of the developer itself is deteriorated. Therefore, according to the present embodiment, the gap Sp is formed at the downstream end portion of the rib 44 in the conveyance direction V1 so that the rib 44 and the first blade portion 41 are not in contact with each other.

According to the present embodiment, the second blade portion 42 is provided with an extended portion 42*a* on the upstream side in the direction of rotation V2, having extended the helical shape on the upstream side in the direction of rotation V2 from the upstream end portion 44*a* of the rib 44 in the conveyance direction V1. That is, the second blade portion 42 is formed to extend from the upstream end portion 44*a* of the rib 44 with respect to the conveyance direction V1 on the upstream side in the direction of rotation V2 of the agitating screw 14. According to this configuration, even if some developer may remain after the developer has been scraped by the rib 44 when the rib 44 rotates in the vicinity of the inductance sensor 18, the developer will be conveyed in the conveyance direction V1 and the conveyance property of developer in the developer container 2 can be improved.

First Example

Agitation performance of replenished toner having been replenished from the replenishing port 19 (refer to FIG. 3) by the agitating screw 14 of the present embodiment configured as above was measured by varying the rotational speed of the agitating screw 14, and the results having varied the length of the second blade portion 42 are compared. In this example, variation of measurement value of toner density by the inductance sensor 18 within the developer container 2 during rotation of the agitating screw 14 was measured without replenishing toner to the developing apparatus 1.

Output of the inductance sensor 18 was measured by storing 200 [g] of developer having a toner density of 10% as initial agent in the developer container 2 illustrated in FIG. 3 and rotating the agitating screw 14 in the image forming apparatus 100 illustrated in FIG. 1. The rotational speed of the agitating screw 14 of the developing apparatus 1 was set to 600 [rpm] for high speed and 300 [rpm] for low speed, and the rotational speed of the agitating screw 14 was switched between high speed and low speed repeatedly every five seconds and measured.

Figure 12:
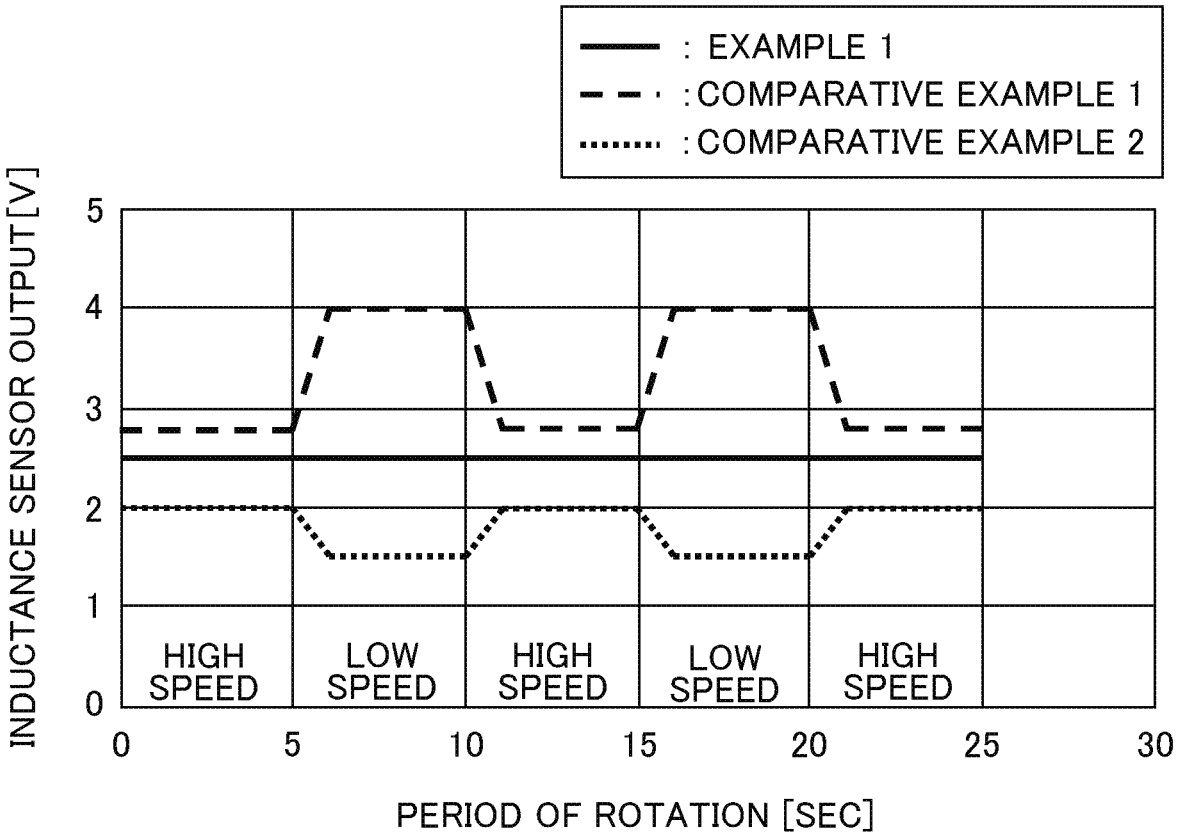
FIG. 12 is a graph illustrating a relationship between period of rotation of the agitating screw and output of the inductance sensor in a case where developer is agitated by the agitating screw according to the example and the agitating screw according to comparative examples.

As illustrated in FIG. 12, the relationship between period of rotation [sec] of the agitating screw 14 on a horizontal axis and output [V] (average value) of the inductance sensor 18 on a vertical axis was calculated. The inductance sensor 18 of the present example uses a sensor having a maximum output of 5 [V], and resistance of the inductance sensor 18 is adjusted so that the initial output of the inductance sensor 18 at high speed is 2.5 [V]. It shows that the toner density in the vicinity of the inductance sensor 18 is low if the output of the inductance sensor 18 becomes higher than the initial value and that the toner density in the vicinity of the inductance sensor 18 is high if the output of the inductance sensor 18 becomes lower than the initial value. In this measurement process, the agitating screw 14 is rotated without replenishing toner to the developing apparatus 1, so that the output of the inductance sensor 18 should preferably be constant.

Example 1

In example 1, the length of the second blade portion 42 in the circumferential direction was set to one-eighth of a turn from the position continued to an end portion 44*a* of the rib 44 to a downstream side in the direction of rotation V2. The result is illustrated by a solid line in FIG. 12. As illustrated by the solid line in the drawing, in Example 1, it has been confirmed that the output of the inductance sensor 18 is constant.

Comparative Example 1

In comparative example 1, the length of the second blade portion 42 in the circumferential direction was set longer than one turn from the position continued to the end portion 44*a* of the rib 44 to the downstream side in the direction of rotation V2. Now, measurement was performed for a case where the rib 44 illustrated in FIG. 10A is connected to the continuous first blade portion 41. The result is shown by a broken line in FIG. 12. As shown by the broken line in the drawing, in comparative example 1, the output of the inductance sensor 18 became significantly high during low speed operation than during high speed operation. This result corresponds to the difference of bulk densities of FIGS. 10A and 10B.

Comparative Example 2

In comparative example 2, the length of the second blade portion 42 in the circumferential direction was set to zero turns from the position continued to the end portion 44*a* of the rib 44 to the downstream side in the direction of rotation V2. In this example, the rib 44 was arranged independently and not connected to the second blade portion 42. The result is shown by a dotted line in FIG. 12. As illustrated by the dotted line in the drawing, in comparative example 2, the output of the inductance sensor 18 during low speed has become significantly small compared to during high speed operation, in contrast to the comparative example 1. This is caused by the developer not being easily transmitted to the rib 44.

Second Example

Next, regarding the agitating screw 14 of the present embodiment, a relationship between screw length in the circumferential direction of the second blade portion 42 continuous to the rib 44 and output difference of the inductance sensor 18 in a state where the rotational speed is varied between high speed and low speed was measured, and results were compared with the lengths of the second blade portion 42 varied. In this example, the screw length in the circumferential direction of the second blade portion 42 continuous to the rib 44 was divided by a normal circumferential direction length of the second blade portion 42. Further, the output of the inductance sensor 18 was set to 5 [V] and amplitude between high speed and low speed operation of the inductance sensor 18 was set to fall in the range of 0.5 to 4.5 [V]. These values are set as above since the output of the inductance sensor 18 may exceed the detectable value if the output became as low as 0 [V] or 5 [V], and the determination of toner density may become inaccurate. The results are shown in Table 1 and FIG. 13.

TABLE 1

| | SCREW LENGTH/ LENGTH OF ONE TURN | OUTPUT DIFFERENCE BETWEEN HIGH SPEED AND LOW SPEED[V] |
|---|---|---|
| COMPARATIVE EXAMPLE 3 | 1.00 (1/1) | 1.2 |
| COMPARATIVE EXAMPLE 4 | 0.50 (1/2) | 0.8 |
| COMPARATIVE EXAMPLE 5 | 0.33 (1/3) | 0.5 |
| COMPARATIVE EXAMPLE 6 | 0.25 (1/4) | 0.33 |
| EXAMPLE 2 | 0.20 (1/5) | 0.2 |
| EXAMPLE 3 | 0.13 (1/8) | 0.0 |
| EXAMPLE 4 | 0.07 (1/15) | −0.2 |
| COMPARATIVE EXAMPLE 7 | 0.00 | −0.5 |

Example 2

A screw continued for one-fifth of a turn was used as the second blade portion 42 for example 2. A calculated value obtained by dividing the length of the second blade portion 42 by a normal pitch was 0.20. As a result of measurement, the difference of output of the inductance sensor 18 between high speed and low speed operations was 0.2 [V].

Example 3

A screw continued for one-eighth of a turn was used as the second blade portion 42 for example 3. A calculated value obtained by dividing the length of the second blade portion 42 by a normal pitch was 0.13. As a result of measurement, the difference of output of the inductance sensor 18 between high speed and low speed operations was 0.0 [V].

Example 4

A screw continued for one-fifteenth of a turn was used as the second blade portion 42 for example 4. A calculated value obtained by dividing the length of the second blade portion 42 by a normal pitch was 0.07. As a result of measurement, the difference of output of the inductance sensor 18 between high speed and low speed operations was −0.2 [V].

Comparative Example 3

A screw continued for one turn or more was used as the second blade portion 42 for comparative example 3, and in the present example, a continuous screw having a length corresponding to one turn without a discontinuous cutout portion was used. A calculated value obtained by dividing the length of the second blade portion 42 by a normal pitch was 1.00. As a result of measurement, the difference of output of the inductance sensor 18 between high speed and low speed operations was 1.2 [V].

Comparative Example 4

A screw continued for one-half of a turn was used as the second blade portion 42 for comparative example 4. A calculated value obtained by dividing the length of the second blade portion 42 by a normal pitch was 0.50. As a result of measurement, the difference of output of the inductance sensor 18 between high speed and low speed operations was 0.8 [V].

Comparative Example 5

A screw continued for one-third of a turn was used as the second blade portion 42 for comparative example 5. A calculated value obtained by dividing the length of the second blade portion 42 by a normal pitch was 0.33. As a result of measurement, the difference of output of the inductance sensor 18 between high speed and low speed operations was 0.5 [V].

Comparative Example 6

A screw continued for one-fourth of a turn was used as the second blade portion 42 for comparative example 6. A calculated value obtained by dividing the length of the second blade portion 42 by a normal pitch was 0.25. As a result of measurement, the difference of output of the inductance sensor 18 between high speed and low speed operations was 0.33 [V].

Comparative Example 7

No second blade portion 42 was provided, that is, an independent rib 44 was provided as comparative example 7 with the length of the second blade portion 42 set to zero turns. A calculated value obtained by dividing the length of the second blade portion 42 by a normal pitch was 0.00. As a result of measurement, the difference of output of the inductance sensor 18 between high speed and low speed operations was −0.5 [V].

Figure 13:
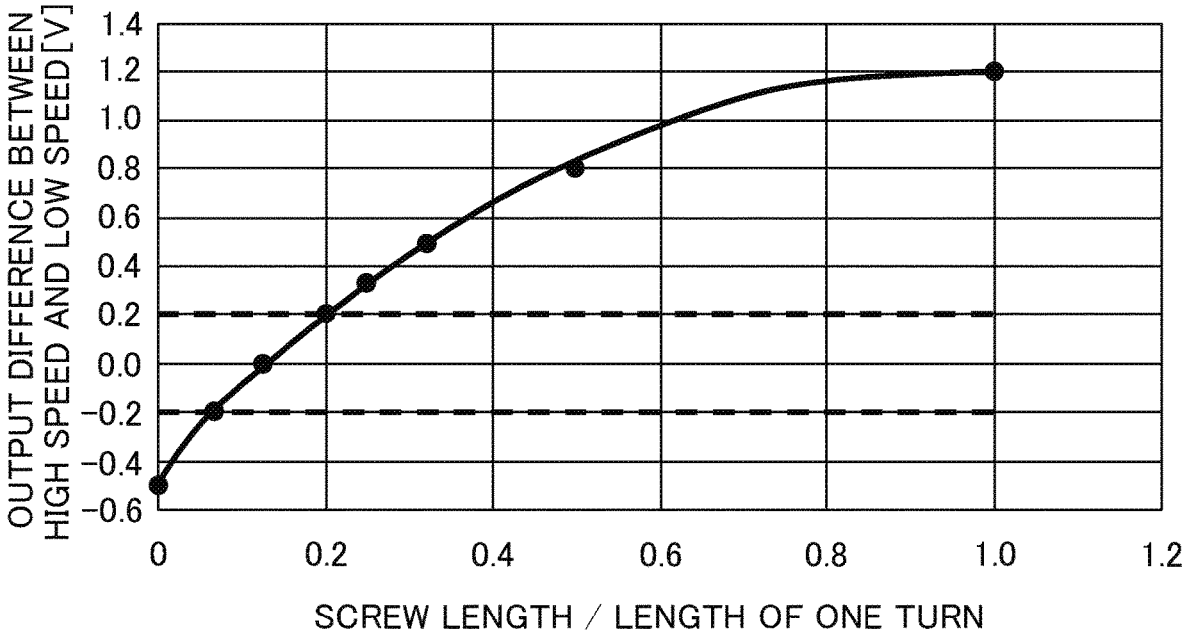
FIG. 13 is a graph illustrating a relationship between length of agitating screw and difference of output of inductance sensor during high speed rotation and low speed rotation of a case where the developer is agitated by the agitating screw according to the example and the agitating screw according to the comparative examples.

In the present embodiment, toner density is detected in the range of 4 [V] as described earlier, so that the variation of detection is aimed to fall within approximately 5%, or 0.2 [V], of the value. Therefore, it is preferable for the output difference of the inductance sensor 18 between high speed and low speed operations obtained as a result of the present example to fall within ±0.2 [V] (within the range of the broken line in FIG. 13). Therefore, as illustrated in FIG. 13, it has been confirmed according to the present embodiment that the length of the second blade portion 42 should preferably be one-fifteenth or more and one-fifth or less of a turn of the screw in the direction of rotation V2 of the agitating screw 14. Especially, it has been confirmed that the length of the second blade portion 42 should most preferably be one-eighth of a turn.

As described, according to the developing apparatus 1 of the present embodiment, the second blade portion 42 having a helical shape is provided continuously to the upstream end portion 44*a* of the rib 44 on the agitating screw 14. Further, the second blade portion 42 has a length not more than one-third of a turn from the upstream end portion 44*a* of the rib 44 toward the downstream side in the direction of rotation V2 of the agitating screw 14. Therefore, the variation of bulk density of the developer 60 accumulated on the rib 44 of the agitating screw 14 due to the difference of rotational speed of the agitating screw 14 can be suppressed. Thereby, according to the developing apparatus 1 of the present embodiment, the bulk density of developer conveyed by the agitating screw 14 can be stabilized and the measurement accuracy of toner density by the inductance sensor 18 can be improved.

According further to the developing apparatus 1 of the present embodiment, the gap Sp is provided between the rib 44 and the first blade portion 41 positioned adjacent to and downstream of the rib 44 in the conveyance direction V1. Therefore, conveyance of developer in the conveyance direction V1 can be prevented from being blocked between the rib 44 and the first blade portion 41 positioned adjacent to and downstream of the rib 44, so that the conveyance property of developer can be improved.

Second Embodiment

Next, a second embodiment of the present disclosure will be described in detail with reference to FIG. 14. The present embodiment differs from the first embodiment in that the multirow screw includes two rows of screws. The other configurations are similar to the first embodiment, so that the components are assigned with the same reference numbers and detailed descriptions are omitted.

Figure 14:
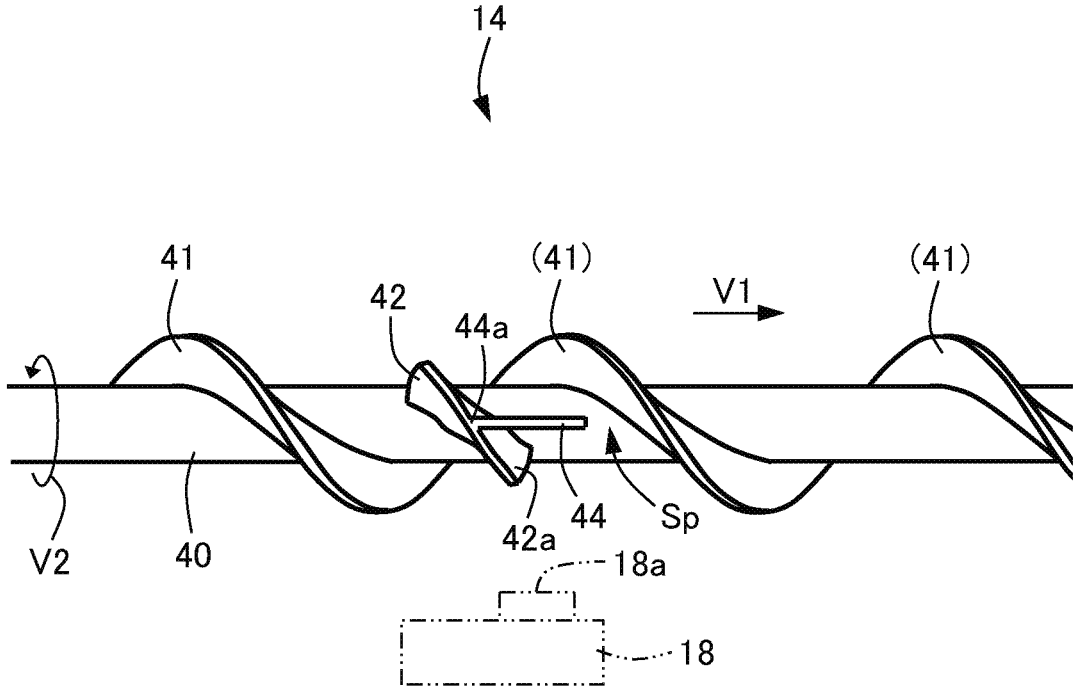
FIG. 14 is a side view illustrating a major portion of an agitating screw according to a second embodiment.

In the present embodiment, the agitating screw 14 is a two-row screw including the first blade portion 41 and the second blade portion 42 having different phases, as illustrated in FIG. 14. The first blade portion 41 and the second blade portion 42 are arranged with phases displaced by 180°, for example. Similar to the first embodiment, the second blade portion 42 has a helical shape with a cutout portion, that is, a gap portion where the outer end portion in the radial direction of the blade is discontinuous, and it is provided continuously to the upstream end portion 44*a* of the rib 44. Further, a screw having a discontinuous area (not shown) is adopted as the first blade portion 41. In the present embodiment, a screw having a pitch of 30 [mm], a helical diameter of 14 [mm] and a diameter of the screw shaft 40 of 6 [mm] is used as the agitating screw 14 serving as the two-row screw. The agitating screw 14 has an improved screw conveyance performance by adopting a two-row screw in addition to having an improved agitation property by adopting a discontinuous helical-shaped screw configuration.

Using the above-described agitating screw 14, the output difference of the inductance sensor 18 while switching the rotational speed between high speed and low speed was measured using a screw with the second blade portion 42 formed continuously for one-eighth of a turn, similar to example 5 of the first embodiment. As a result, it has been confirmed that the output difference of the inductance sensor 18 while switching between high speed and low speed operations was reduced by adopting a configuration where the discontinuous second blade portion 42 is provided continuously to the rib 44, similar to the first embodiment.

As described, according to the developing apparatus 1 of the present embodiment, the second blade portion 42 having a helical shape is provided continuously to the upstream end portion 44*a* of the rib 44 in the agitating screw 14. Further, the second blade portion 42 has a length not more than one-third of a turn from the upstream end portion 44*a* of the rib 44 to the downstream side in the direction of rotation V2 of the agitating screw 14. Therefore, the variation of bulk density of the developer 60 accumulated on the rib 44 of the agitating screw 14 caused by the change of rotational speed of the agitating screw 14 can be suppressed. Thereby, according to the developing apparatus 1 of the present embodiment, bulk density of developer conveyed by the agitating screw 14 can be stabilized and the measurement accuracy of toner density by the inductance sensor 18 can be improved.

Third Embodiment

Next, a third embodiment of the present disclosure will be described in detail with reference to FIG. 15. The present embodiment differs from the first embodiment in that a one-row screw is used instead of the multirow screw. The other configurations are similar to the first embodiment, so that the components are denoted with the same reference numbers and detailed descriptions thereof are omitted.

Figure 15:
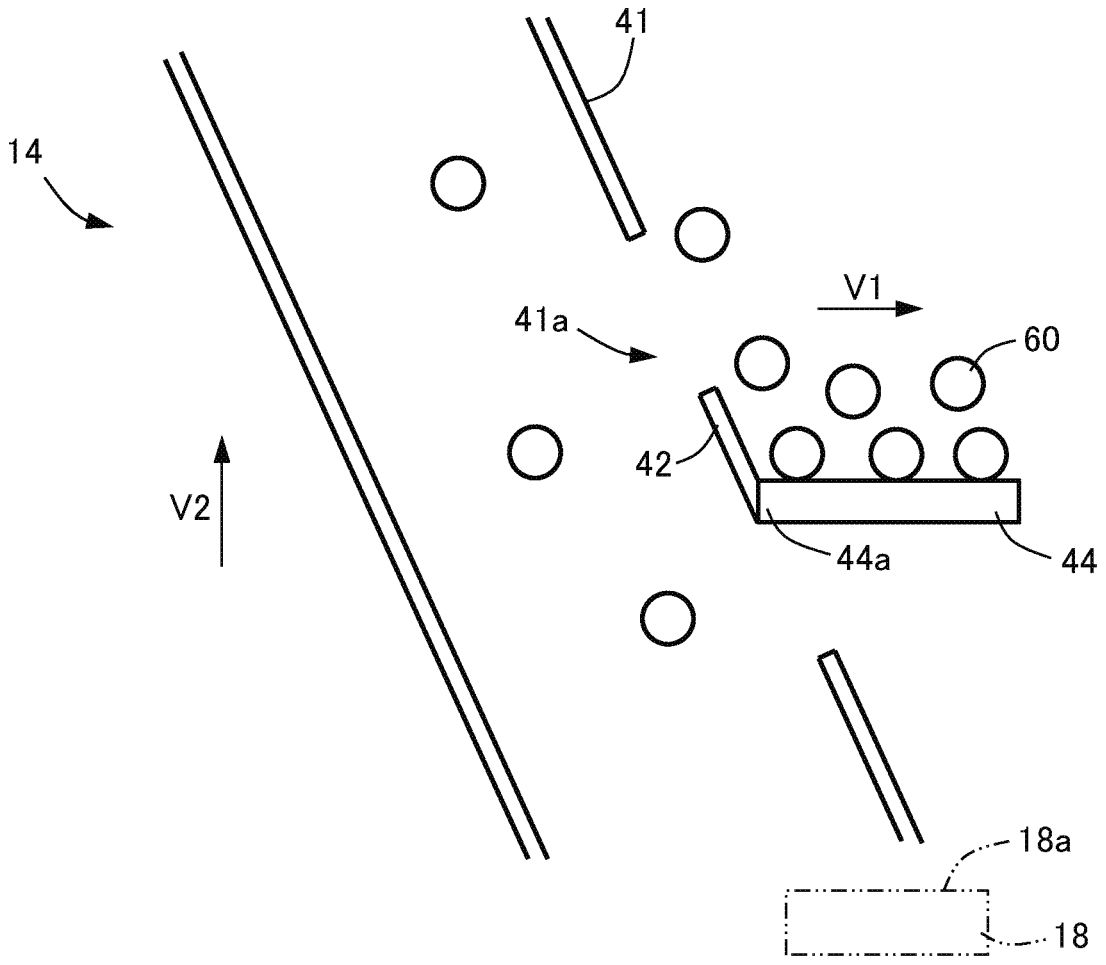
FIG. 15 is a schematic side view illustrating a major portion of an agitating screw according to a third embodiment.

According to the present embodiment, the agitating screw 14 is a one-row screw including the first blade portion 41 and the second blade portion 42 having consistent phases, as illustrated in FIG. 15. That is, the first blade portion 41 includes a gap portion 41*a* where the blade is not formed, and the second blade portion 42 is formed to the gap portion 41*a* of the first blade portion 41. Similar to the first embodiment, the second blade portion 42 has a helical shape with a cutout portion, that is, a gap portion where the outer end portion in the radial direction of the blade is discontinuous, and the second blade portion 42 is provided continuously to the upstream end portion 44*a* of the rib 44. In the present embodiment, a one-row screw having a pitch of 30 [mm], a helical diameter of 14 [mm] and a screw shaft 40 having a diameter of 6 [mm] is used as the agitating screw 14.

Using the above-described agitating screw 14, the output difference of the inductance sensor 18 while switching the rotational speed between high speed and low speed was measured using a screw with the second blade portion 42 formed continuously for one-eighth of a turn, similar to example 5 of the first embodiment. As a result, it has been confirmed that the output difference of the inductance sensor 18 while switching between high speed and low speed operations is reduced by adopting a configuration where the discontinuous second blade portion 42 is provided continuously to the rib 44, similar to the first embodiment.

As described, according to the developing apparatus 1 of the present embodiment, the second blade portion 42 having a helical shape is provided continuously to the upstream end portion 44*a* of the rib 44 in the agitating screw 14. Further, the second blade portion 42 has a length not more than one-third of a turn from the upstream end portion 44*a* of the rib 44 to the downstream side in the direction of rotation V2 of the agitating screw 14. Therefore, the variation of bulk density of the developer 60 accumulated on the rib 44 of the agitating screw 14 caused by the change of rotational speed of the agitating screw 14 can be suppressed. Thereby, according to the developing apparatus 1 of the present embodiment, bulk density of developer conveyed by the agitating screw 14 can be stabilized and the measurement accuracy of toner density by the inductance sensor 18 can be improved.

According to the developing apparatus 1 and the agitating screw 14 according to the present disclosure, bulk density of developer conveyed by the agitating screw 14 can be stabilized and measurement accuracy of toner density by the inductance sensor 18 can be improved.

The conditions of the screw configuration of the developing apparatus 1 according to the respective embodiments described above are mere examples, and various settings such as the number of rows of the screw and the screw pitch are not fixed and may vary depending on the developer and the developing apparatus 1 being used.

Other Embodiments

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-105871, filed Jun. 6, 2019 which is hereby incorporated by reference herein in its entirety.

What is claimed is:

1. A developing apparatus comprising:

a developer container configured to accommodate developer comprising toner and carrier;

a conveyance screw comprising a shaft portion provided rotatably on the developer container, and a first blade portion comprising a helical shape, the first blade portion being configured to rotate integrally with the shaft portion and convey the developer accommodated in the developer container in a conveyance direction by rotation; and an inductance sensor arranged to oppose a portion, in a circumferential direction, of the conveyance screw and configured to detect toner density of the developer accommodated in the developer container, wherein the conveyance screw further comprises a rib, protruding in a radial direction from the shaft portion, provided at a position opposed to the inductance sensor, and a second blade portion provided continuously to an upstream end portion of the rib with respect to the conveyance direction and configured to convey the developer to the conveyance direction by rotation, and wherein the second blade portion is formed to extend not more than one-third of a turn from the upstream end portion of the rib downstream in a direction of rotation of the conveyance screw when viewed in an axial direction of the conveyance screw.

2. The developing apparatus according to claim 1, wherein a gap is formed between the rib and the first blade portion positioned adjacent to and downstream of the rib in the conveyance direction.

3. The developing apparatus according to claim 1, wherein the second blade portion is formed to extend upstream in the direction of rotation of the conveyance screw from the upstream end portion of the rib.

4. The developing apparatus according to claim 1, wherein the second blade portion has a phase that differs from the first blade portion in the circumferential direction when a cross section including the second blade portion orthogonal to the axial direction is viewed in the axial direction.

5. The developing apparatus according to claim 1, wherein the conveyance screw further comprises a third blade portion, comprising a helical shape, configured to rotate integrally with the shaft portion and convey the developer accommodated in the developer container to the conveyance direction by rotation, and wherein the first blade portion, the second blade portion and the third blade portion are arranged in order in the conveyance direction.

6. The developing apparatus according to claim 5, wherein the third blade portion comprises a gap portion in a vicinity of the rib where a blade is not formed, and wherein a downstream end of the rib in the conveyance direction is opposed to the first blade portion in the conveyance direction.

7. The developing apparatus according to claim 1, wherein the first blade portion comprises a gap portion where a blade is not formed, and wherein the second blade portion is formed in the gap portion of the first blade portion.

8. The developing apparatus according to claim 1, wherein the second blade portion comprises a same pitch length and a same outer diameter as the first blade portion.

9. The developing apparatus according to claim 1, wherein the second blade portion is formed to extend not less than one-fifteenth of a turn and not more than one-fifth of a turn from the upstream end portion of the rib downstream in the direction of rotation of the conveyance screw when viewed in the axial direction of the conveyance screw.

10. The developing apparatus according to claim 1, wherein in a case where a height of the first blade portion from the shaft portion is set to 100%, the height of the rib is within a range of 88% to 107% from the shaft portion.

11. A conveyance screw comprising:

a shaft portion provided rotatably on a developer container configured to accommodate developer comprising toner and carrier;

a first blade portion comprising a helical shape and configured to rotate integrally with the shaft portion and convey developer accommodated in the developer container in a conveyance direction by rotation;

a rib, protruding in a radial direction from the shaft portion, provided at a position opposed to an inductance sensor arranged to oppose a portion, in a circumferential direction, of the conveyance screw and configured to detect toner density of the developer accommodated in the developer container; and a second blade portion provided continuously to an upstream end portion of the rib with respect to the conveyance direction and configured to convey the developer to the conveyance direction by rotation, wherein the second blade portion is formed to extend not more than one-third of a turn from the upstream end portion of the rib downstream in a direction of rotation of the conveyance screw when viewed in an axial direction of the conveyance screw.

12. The conveyance screw according to claim 11, wherein a gap is formed between the rib and the first blade portion positioned adjacent to and downstream of the rib in the conveyance direction.

13. The conveyance screw according to claim 11, wherein the second blade portion is formed to extend upstream in the direction of rotation of the conveyance screw from the upstream end portion of the rib.

14. The conveyance screw according to claim 11, wherein the second blade portion has a phase that differs from the first blade portion in the circumferential direction when a cross section including the second blade portion orthogonal to the axial direction is viewed in the axial direction.

15. The conveyance screw according to claim 11, further comprising:

a third blade portion, comprising a helical shape, configured to rotate integrally with the shaft portion and convey the developer accommodated in the developer container to the conveyance direction by rotation, and wherein the first blade portion, the second blade portion and the third blade portion are arranged in order in the conveyance direction.

16. The conveyance screw according to claim 15, wherein the third blade portion comprises a gap portion in a vicinity of the rib where a blade is not formed, and wherein a downstream end of the rib in the conveyance direction is opposed to the first blade portion in the conveyance direction.

17. The conveyance screw according to claim 11, wherein the first blade portion comprises a gap portion where a blade is not formed, and wherein the second blade portion is formed in the gap portion of the first blade portion.

18. The conveyance screw according to claim 11, wherein the second blade portion has a same pitch length and a same outer diameter as the first blade portion.

19. The conveyance screw according to claim 11, wherein the second blade portion is formed to extend not less than one-fifteenth of a turn and not more than one-fifth of a turn from the upstream end portion of the rib downstream in the direction of rotation of the conveyance screw when viewed in the axial direction of the conveyance screw.

20. The conveyance screw according to claim 11, wherein in a case where a height of the first blade portion from the shaft portion is set to 100%, the height of the rib is within a range of 88% to 107% from the shaft portion.

* * * * *